United States Patent [19]

Cook et al.

[11] Patent Number: 4,605,382

[45] Date of Patent: Aug. 12, 1986

[54] FIGURE WHEREIN LEG MOVEMENT PRODUCES WING-LIKE MOVEMENT OF ARMS

[75] Inventors: Stuart A. Cook, New Richmond; Phillip G. Reed, Loveland; Michael C. Scarpa, Cincinnati, all of Ohio

[73] Assignee: CPG Products Corp., Minneapolis, Minn.

[21] Appl. No.: 699,618

[22] Filed: Feb. 8, 1985

[51] Int. Cl.[4] ..... A63H 3/20

[52] U.S. Cl. ..... 446/330; 446/333; 446/334; 446/336

[58] Field of Search ..... 446/330, 333, 334, 335, 446/336, 340, 341, 352–355, 358, 359, 365, 156, 158, 159

[56] References Cited

U.S. PATENT DOCUMENTS

| | | | |
|---|---|---|---|
| 140,259 | 6/1873 | Eaton | 446/158 |
| 839,770 | 12/1906 | Kalkbrenner | 446/362 |
| 1,359,778 | 11/1920 | Zimmerman | 446/330 |
| 1,800,775 | 4/1931 | Bostwick | 446/336 |
| 3,147,566 | 9/1964 | Ong | 446/359 |
| 3,835,581 | 9/1974 | Grieder | 446/158 |
| 3,874,112 | 4/1975 | Sapkus et al. | 446/336 X |

FOREIGN PATENT DOCUMENTS

| | | | |
|---|---|---|---|
| 642713 | 9/1950 | United Kingdom | 446/352 |

*Primary Examiner*—F. Barry Shay

*Attorney, Agent, or Firm*—Gene O. Enockson; L. MeRoy Lillehaugen; Stuart R. Peterson

[57] ABSTRACT

The toy action figure has a pair of arms mounted for movement in a wing-like manner and one leg mounted for rocking movement relative to the figure's other leg. An actuating mechanism contained within the hollow torso transmits the rocking leg movement to the arms so that the wind-like movement is achieved. The actuating mechanism includes an arcuate gear rack associated with each of the arms and said one leg, there being several idler gears so that two of the idler are engaged with the two arcuate racks for the arms and the remaining idler gear is engaged with the gear rack for the one leg. The idler gear for one of the arms is additionally engaged with the idler gear for the other arm and also with the idler gear for the one leg.

15 Claims, 7 Drawing Figures

FIGURE WHEREIN LEG MOVEMENT PRODUCES WING-LIKE MOVEMENT OF ARMS

BACKGROUND OF THE INVENTION

This invention relates generally to toy figures having movable limbs, and pertains more particularly to an action figure in which the manual rocking of one leg in a direction toward the other leg produces a wing-like movement of both arms about generally horizontal axes.

SUMMARY OF THE INVENTION

An object of the present invention is to provide a toy action figure which can be readily manipulated by children of virtually all ages. In this regard, an aim of our invention is to enable the child to press one leg toward the other leg, and by way of an actuating mechanism contained in the torso of the figure, the arms are caused to move up and down, that is, toward and away from the torso, in a wing-like fashion.

Another object is to provide an action figure that will be quite rugged, being capable of withstanding rough handling. More specifically, an aim of the invention is to provide a series or train of gears within the torso that remain enmeshed with each other throughout the entire manipulation of the leg employed for actuating the mechanism, the gears also remaining engaged throughout the resulting arm movement. Also, it is within the scope of our invention to have the entire actuating mechanism, the leg which produces the arm movement, and the arms themselves all return to an initial or unactuated position after the child has released the pressure he or she has applied to the leg that causes the arms to move.

Yet another object of the invention is to provide an action figure that can be miniaturized. In this way, there can be a substantial savings of material costs, and yet the novelty provided by our action figure is preserved. Stated somewhat differently, the toy action figure can be fabricated so that it is quite small and occupies but little space when being used or stored.

Still further, the invention has for an object the providing of a figure that can assume the form of a well-known comic character, particularly as far as its limb movements are concerned, so that the action figure will continue to possess a high degree of interest for the child.

Briefly, our invention contemplates a toy action figure comprising a hollow torso to which is mounted a leg which is manually rocked toward the other leg. An actuating mechanism within the torso transmits and converts the rocking motion to both arms so that the arms are simultaneously moved from a position relatively close to the torso to a position spaced farther from the torso. Stated somewhat differently, the manual rocking of the particular leg selected for manipulation is converted, as far as its motion is concerned, to a wing-like arm movement, doing so through an actuating mechanism within the torso that includes a plurality or series of gears.

BRIEF DESCRIPTION OF THE DRAWINGS

FIG. 1 is a front elevation of a toy action figure exemplifying our invention, the view depicting the figure in an unactuated condition;

DESCRIPTION OF THE PREFERRED EMBODIMENT

Figure 2:
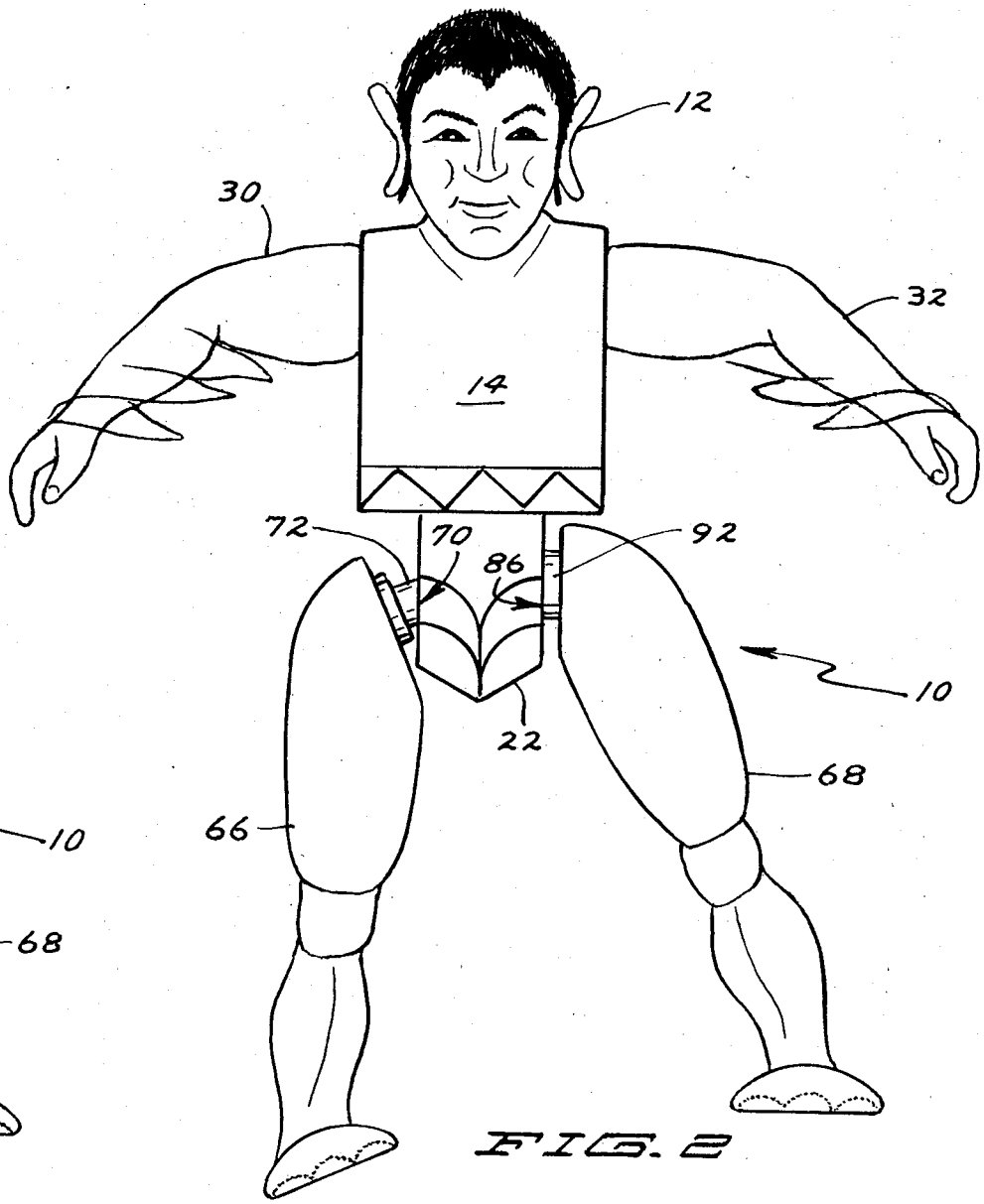
FIG. 2 is a front elevational view but with the right leg pressed toward the left leg to produce a wing-like upward movement of the arms from the position shown in FIG. 1.

The toy action figure selected to illustrate our invention has been indicated generally by the reference numeral 10. The action FIG. 10 includes a head 12 and a hollow upper torso 14.

Figure 3:
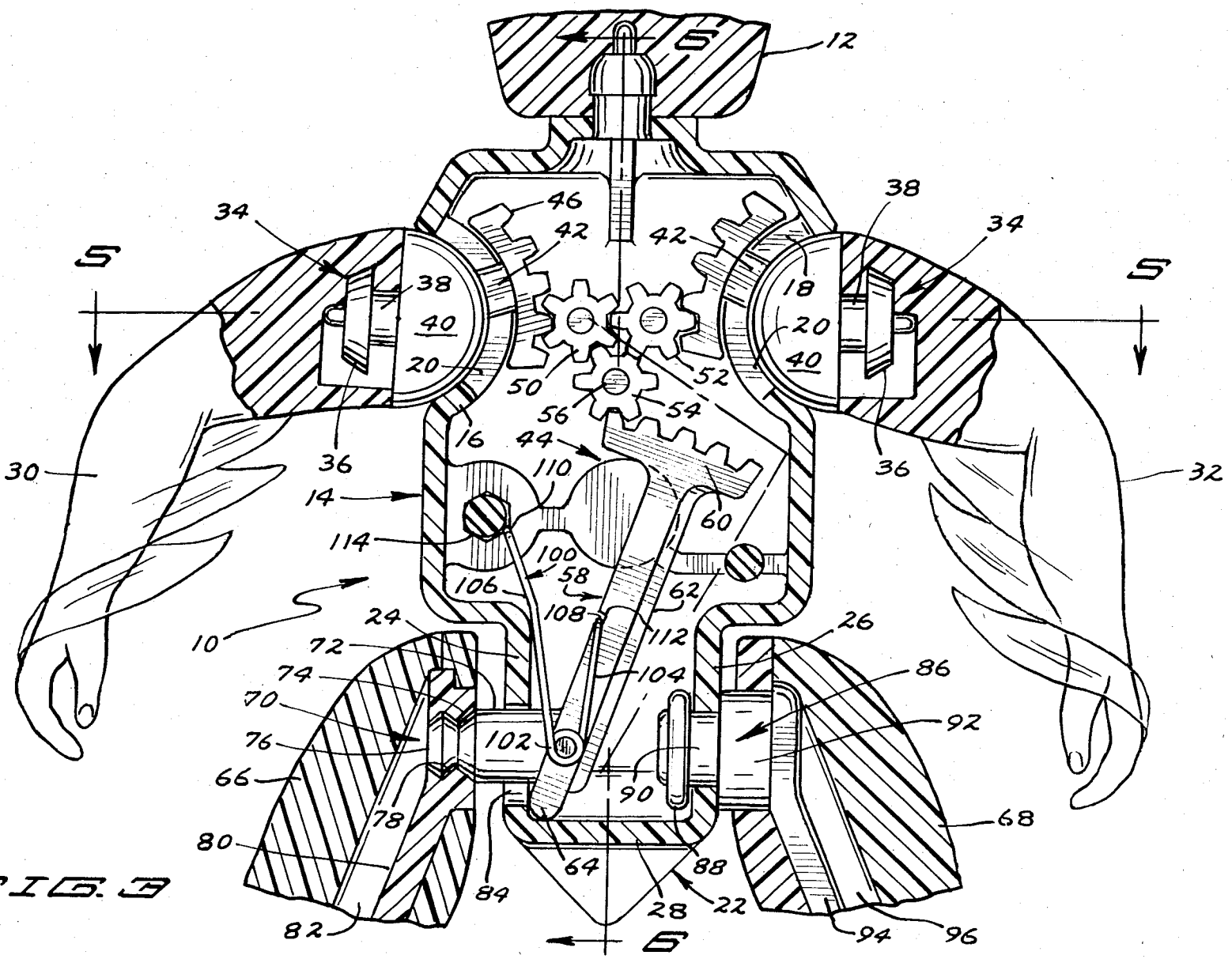
FIG. 3 is an enlarged front elevational view corresponding to FIG. 1, portions of the legs and arms having been shown in section and the chest of the figure removed so as to expose to view the actuating mechanism contained within the hollow torso.
Figure 4:
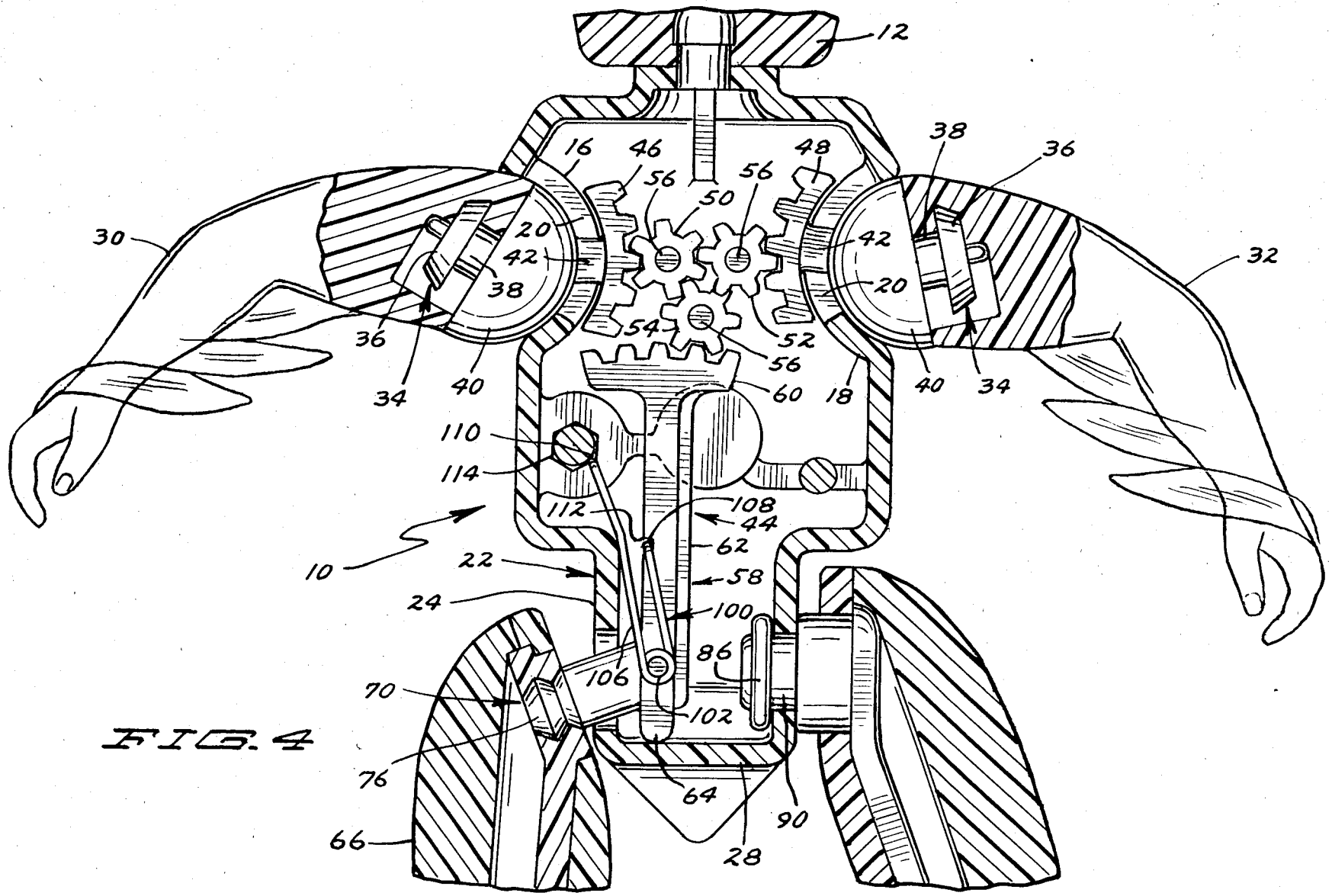
FIG. 4 is a view like FIG. 3 but with the leg and arms pictured in the positions into which they are actuated by the manual movement of the right leg.

At this time attention is directed to right and left shoulder ball cups or sockets 16 and 18, these sockets 16, 18 being integral with the hollow torso 14, as can be readily appreciated from FIGS. 3 and 4. Each socket 16 and 18 is formed with a vertical slot 20. More will be said presently concerning the role played by the shoulder sockets 16, 18 and the vertical slots 20 formed therein. The action FIG. 10 is also provided with a lower torso 22 having sidewalls 24, 26 and a base or bottom panel 28.

The toy action FIG. 10 also has a right arm 30 and a left arm 32. The arms 30, 32 are each provided with an arm mounting unit 34 which includes a flange 36, a cylindrical sleeve 38 and a ball member 40, the member 40, more precisely being a portion or segment of a ball. Extending inwardly from each ball member 40 is a flat shank 42 that is movable in the slot 20 with which it is associated.

Referring now to an actuating mechanism for the arms 30, 32, the actuating mechanism having been denoted generally by the reference numeral 44, it is to be observed that mechanism 44 is comprised of a gear segment or arcuate rack 46 which is integral with the flat shank 42 for the right arm 30, and a similar gear segment or arcuate rack 48 integral with the flat shank 42 associated with the left arm 32. Although the principal function of the gear segments or arcuate racks 46 and 48 is to transmit motion to the arms 30 and 32, the gear segments or arcuate racks 46 and 48 additionally serve to retain the ball members 40 in a nested relation with their shoulder sockets 16 and 18.

The actuating mechanism 44 additionally includes a plurality of idler gears or pinions 50, 52 and 54, each being mounted on a shaft 56 suitably journaled for rotation in molded portions of the upper torso 14. From FIG. 7, it can be perceived that the gear 50 is relatively long and that the gears 52 and 54 are relatively short. As the description progresses, it will become apparent that the relatively short gear 54 is in mesh with one end portion of the relatively long gear 50, whereas the short gear 52 is in mesh with the opposite end portion of the relatively long gear 50.

Still further, the actuating mechanism 44 includes a transmission link 58 having a gear segment or arcuate rack 60 integral therewith. The transmission link 58 has a downwardly extending shank 62 formed with a rounded lower end 64 that rocks on the base or bottom panel 28.

The toy action FIG. 10 has a right leg 66 and a left leg 68. There is a mounting unit 70 for the right leg 66 that includes a sleeve 72, a circumferential groove 74 and a head 76. In the illustrated instance, the head 76 is press fitted into a socket 78 formed in the upper end portion of a leg insert 80 that extends downwardly in a leg cavity 82 within the right leg 66. It will be observed from FIGS. 3 and 4 that the sleeve 72 extends laterally outwardly through an aperture 84 formed in the right sidewall 24. The manner in which the leg 66 is attached to the leg mounting unit 70 is not critical; however, the attachment must be rigid enough so that a rocking movement of the right leg 66 will, in turn, rock the transmission link 58 about its lower rounded end 64, the lower rounded end 64 bearing against the upper surface of the base or bottom panel 28.

A mounting unit indicated generally by the reference numeral 86 has a flange 88, a sleeve 90, and a still larger sleeve 92, the larger sleeve 92 being integral with the upper end of a clip 94 that extends downwardly in a cavity 96 provided in the left leg 68. The mounting of the left leg 68 is somewhat less important than the way in which the right leg 66 is mounted. In both instances, though, it is highly desirable that the legs 66 and 68 be pivotal forwardly and rearwardly relative to the torso 14. As far as the right leg 66 is concerned, however, it is important that it be capable of being rocked so as to transmit such rocking action to the transmission link 58.

In order to return the actuating mechanism 44 to its unactuated condition, as illustrated in FIG. 3, there is a hairpin spring 100 having several intermediate turns or convolutions 102 and leg portions 104 and 106, the leg portion 104 having an offset end 108 and the leg portion 106 similarly having an offset end 110. The offset end 108 is received in a notch 112 formed in one edge of the transmission link 58, whereas the offset end 110 is received in a socket 114 formed in a portion of the hollow torso 14.

As far as the general operation of our toy action FIG. 10 is concerned, the child only needs to manipulate the right leg 66, pressing the right leg 66 closer to the left leg 68. The unactuated relation of the right leg 66 is shown in FIGS. 1 and 3, whereas the actuated relationship of the right leg 66 appears in FIGS. 2 and 4.

Describing the operation in more detail, it should be appreciated that the transmission link 58 is rocked about its lower end 64 when the right leg 66 is pressed toward the left leg 68. It is of importance to recognize that the rocking of the right leg 66 in a direction toward the left leg 68 is instrumental in causing the transmission link 58 to swing through an angle from the position in which it appears in FIG. 3 to that in which it appears in FIG. 4. Inasmuch as the gear segment or arcuate rack 60 is engaged or in mesh with the relatively short idler gear 54, it follows that the gear 54 is rotated so as to transmit rotary movement to the relatively long gear 50. Since the relatively long gear 50 is in mesh with the gear segment or arcuate rack 46 associated with the right arm 30, this gear segment 46 is caused to move from the position thereof shown in FIG. 3 to that shown in FIG. 4. At the same time, owing to the fact that the relatively long gear 50 is in mesh with the relatively short gear 52, the relatively short gear 52 is rotated. Being engaged with the gear segment or arcuate rack 48 associated with the left arm 32, the relatively short gear 52 moves the gear segment 48 from the position illustrated in FIG. 3 to that shown in FIG. 4.

Figure 7:
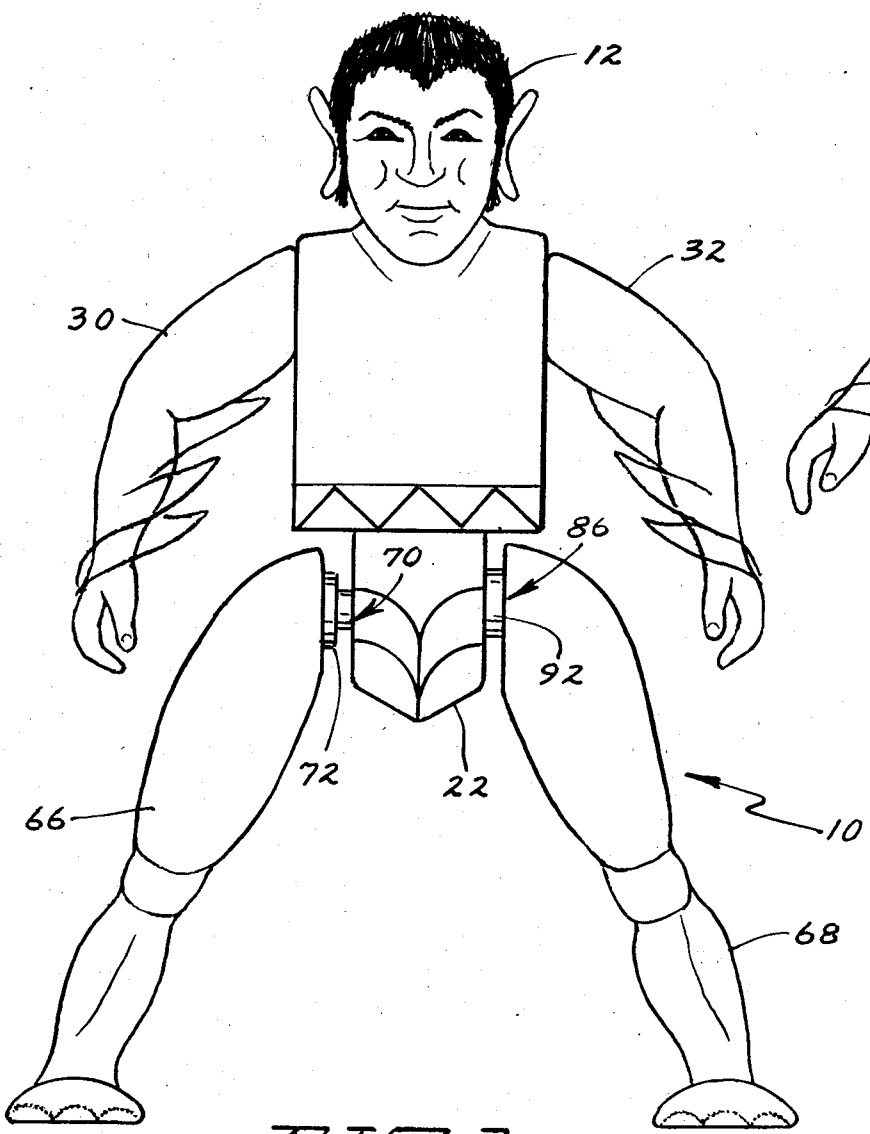
FIG. 7 is a perspective view of the actuating mechanism disassociated from the torso.
Figure 6:
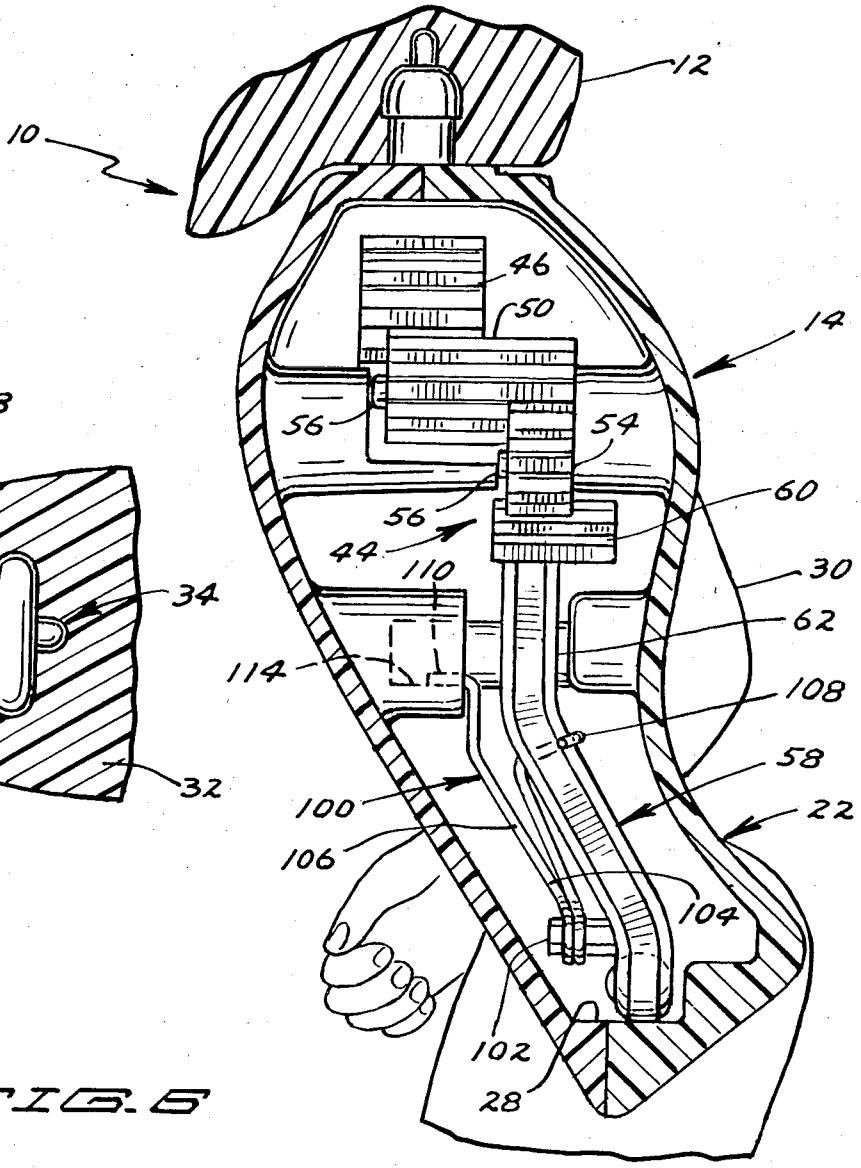
FIG. 6 is a side elevational view of a substantial portion of the actuating mechanism in the torso, the view being taken in the general direction of irregular line 6—6 of FIG. 3.
Figure 5:
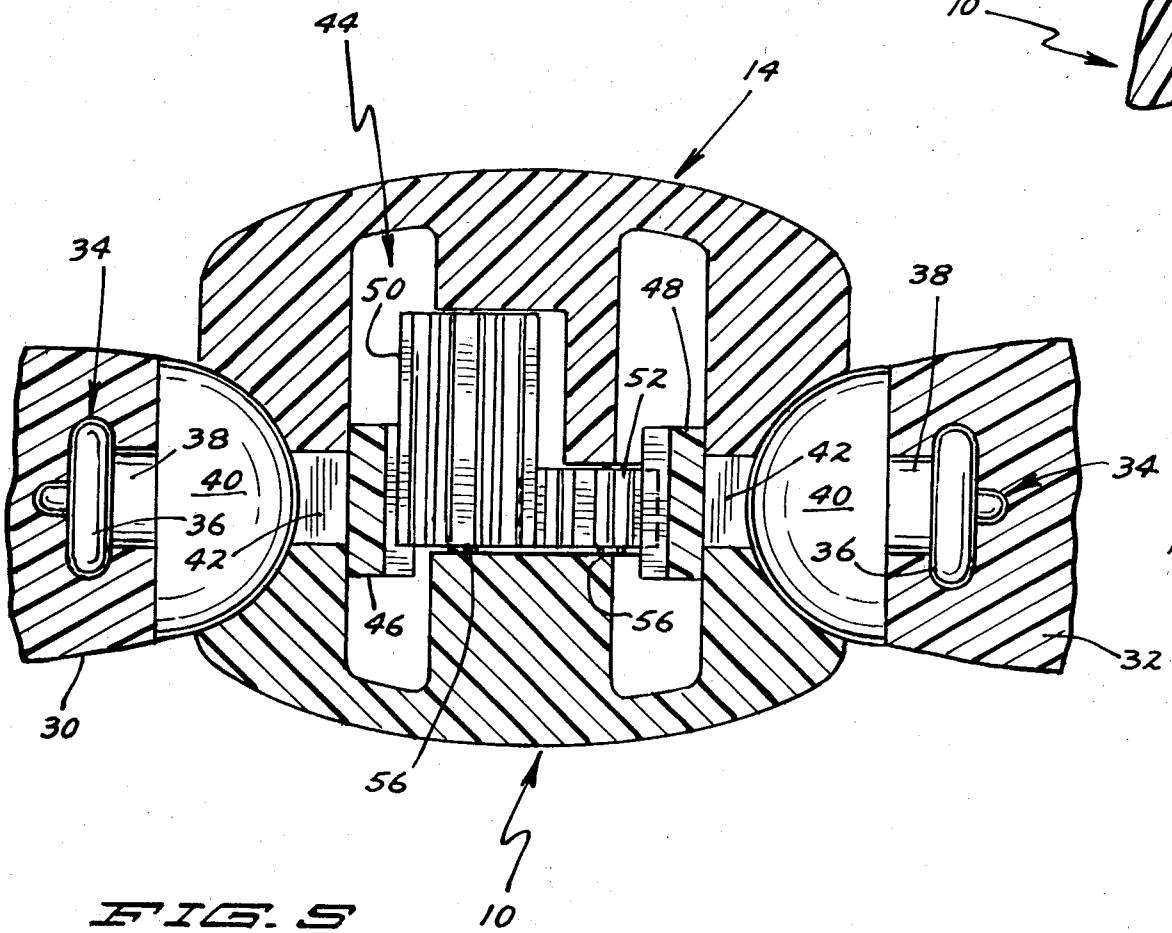
FIG. 5 is a horizontal sectional view taken in the direction of line 5—5 of FIG. 3.
Figure 7:
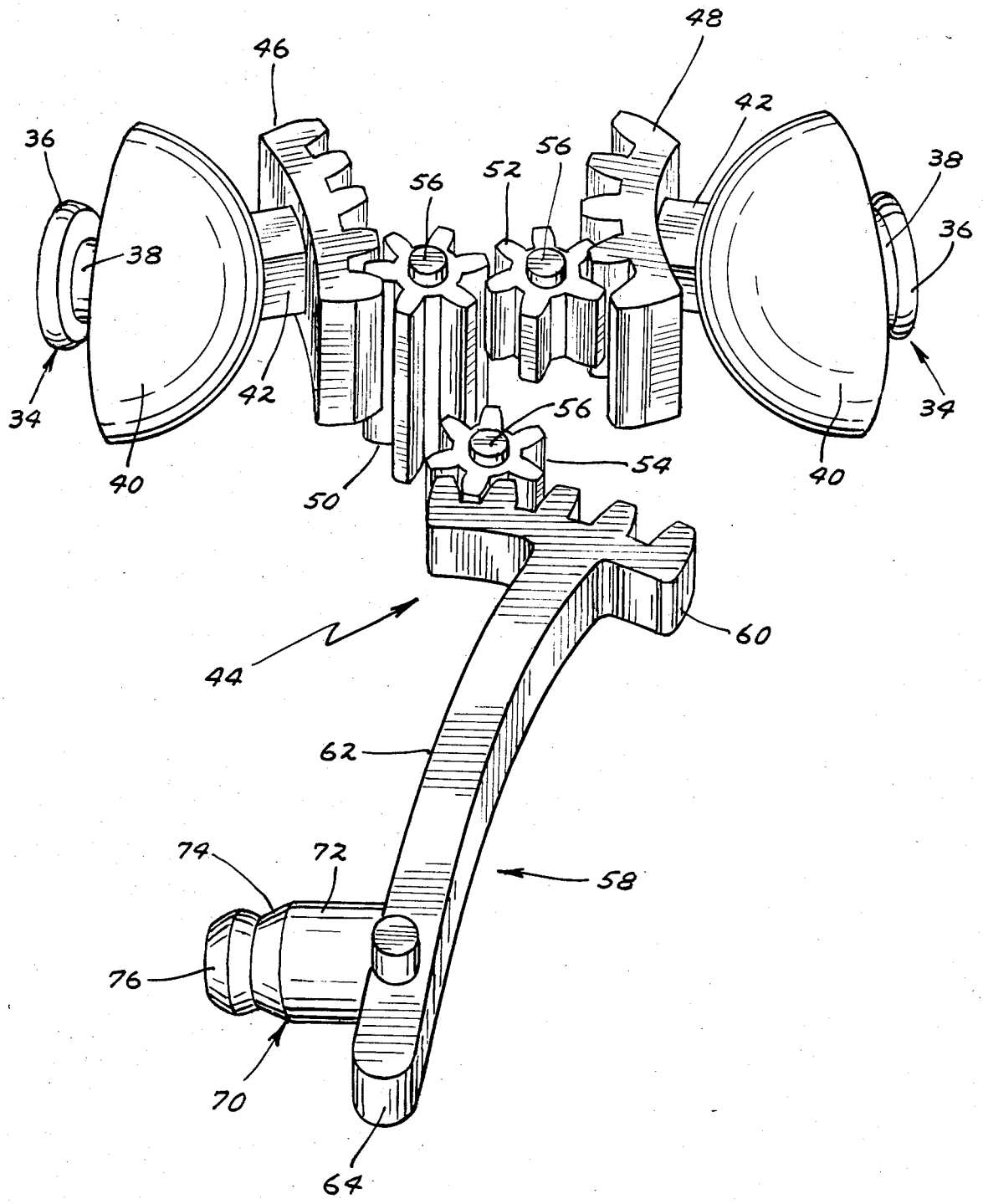

Whereas the various rotational directions of the gears 46, 48, 50, 52, 54 and 60 constituting the gear train can be understood, it is believed, from FIGS. 3 and 4, nonetheless, resort to FIG. 7 should make the gear rotation even more readily understandable. The gear relationship depicted in FIG. 7, it will be recognized, corresponds to that shown in FIG. 3. It perhaps would also be helpful, as far as fully comprehending the relationship of the various gears is concerned, to look at FIGS. 5 and 6, as well. FIG. 5 should make it clear that the relatively long gear 50 is engaged with the relatively short gear 52, whereas FIG. 6 should make it clear that the relatively short gear 54 is engaged with the relatively long gear 50. FIG. 6 additionally shows that the relatively long gear 50 is engaged with the gear segment or arcuate rack 46 associated with the right arm 30.

What should be appreciated, however, is that the actuation of the gear segments or arcuate racks 46, 48, inasmuch as each is integrally carried at the inner end of the flat shank 42 and inasmuch as one flat shank 42 is integral with the ball member 40 for the right arm 30 and the other is integral with the ball member 40 for the left arm 32, causes the ball members 40 to be pivoted or swung about the laterally spaced horizontal axes provided by the ball and socket-like joints 16, 18. Since the arms 30, 32 are constrained for rotation about laterally spaced horizontal axes provided by the interfitting of the ball members 40 in the shoulder ball cups or sockets 16 and 18, it follows that the arms 30, 32 are raised from the lower positions in which they appear in FIGS. 1 and 3 to the more elevated positions in which they appear in FIGS. 2 and 4. This movement can be succinctly described as being a wing-like motion. It should be noted, though, that only one leg, this being the right leg 66, is manipulated to produce the simultaneous wing-like motion of both arms 30 and 32.

When the right leg 66 is released, that is, when the child no longer presses the right leg 66 in the direction of the left leg 68, the hairpin spring 100 acts in a direction to return the transmission link 58 back to the position thereof illustrated in FIG. 3. In other words, the pressing of the right leg 66 toward the left leg 68 causes the spring leg portions 104, 106 to flex and assume a lesser angle with respect to each other, as can be readily perceived from FIG. 4. This stores spring energy that is employed to return the transmission link 58 to the angular position illustrated in FIG. 3. Of course, since the gear segment or arcuate rack 60 is engaged with the relatively short idler gear 54, such angular movement causes a reverse rotation of the idler gear 54 with the consequence that the idler gears 50 and 52 are reversely rotated so as to return the arms 30 and 32 to their initial or unactuated positions appearing in FIG. 3.

We claim:

1. A top action figure comprising a hollow torso, first and second arms, first and second legs, means mounting said first arm for pivotal movement between first and second angular positions with respect to said torso, means mounting said first leg for pivotal movement between first and second angular positions relative to said second leg, and an actuating mechanism interconnecting said first leg with said first arm, said actuating mechanism including an arcuate gear rack fixedly connected to said first arm, an arcuate gear rack fixedly connected to said first leg and idler gear means engaged with each of said gear racks so that manual actuation of said first leg between its said angular positions produces movement of said first arm between its said angular positions.

2. A toy action figure in accordance with claim 1 in which manual movement of said first leg from a first angular position to a second angular position causes said first arm to move from a first angular position to a second angular position.

3. A toy action figure in accordance with claim 1 including means mounting said second arm with respect to said torso so that said second arm is closer to said torso in a first angular position and is farther from said torso in a second angular position, said actuating mechanism including an arcuate gear rack fixedly connected to said second arm, said idler gear means being engaged with all of said arcuate gear racks so that manipulation of said first leg between its said angular positions also produces movement of said second arm between its said angular positions.

4. A toy action figure in accordance with claim 3 in which manipulation of said first leg from its first angular position to its said second angular position causes said first and second arms to move from their respective first positions to their respective second positions.

5. A toy action figure comprising a hollow torso, first and second arms, first and second legs, means mounting said first arm for pivotal movement between first and second angular positions with respect to said torso, means mounting said second arm with respect to said torso so that said second arm is closer to said torso in a first angular position and is farther from said torso in a second angular position, means mounting said first leg for pivotal movement between first and second angular positions relative to said second leg, means interconnecting said first leg with said first and second arms so that manipulation of said first leg from its first angular position to its said second angular position causes said first and second arms to move from their respective first positions to their respective second positions, said interconnecting means including a first arcuate gear rack fixedly connected to said first arm, a second arcuate gear rack fixedly connected to said second arm, a third arcuate gear rack fixedly connected to said first leg, a first idler gear in mesh with said first gear rack, a second idler gear in mesh with said second gear rack, said first and second idler gears being in mesh with each other, and a third idler gear in mesh with said third gear rack and in mesh with said first idler gear.

6. A toy action figure in accordance with claim 5 in which said second idler gear is in mesh with one portion of said first idler gear and said third gear is in mesh with another portion of said first idler gear.

7. A toy action figure in accordance with claim 6 including spring means for returning said first leg and said arms to their said first positions when said first leg is no longer actuated.

8. A toy action figure comprising a hollow torso, a pair of limbs constituting a pair of arms, means pivotably mounting said arms to said torso for wing-like movement relative to said torso, a third limb constituting a leg, means mounting said leg to said torso for rocking movement relative to said torso and means within said torso for moving said arms simultaneously upward as a result of rocking said third limb in one direction and simultaneously downward as a result of rocking said third limb in the other direction to produce said wing-like movement, said means within said torso comprising a plurality of gear members interconnecting said leg with said arms, said gear members including a respective arcuate gear rack fixed to the torso end of each of said limbs and at least one additional gear element rotatably mounted within said torso.

9. A toy action figure comprising a hollow torso, a pair of arms, means mounting said arms for wing-like movement relative to said torso, a leg, means mounting said leg for rocking movement relative to said torso, and a plurality of gear members interconnecting said leg with said arms to produce said wing-like movement, said plurality of gear members including an arcuate gear rack fixed to each of said arms, an arcuate gear rack fixed to said leg, and three idler gears engaged with each other, a respective one of said idler gears being engaged with each of said gear racks.

10. A toy action figure in accordance with claim 9 in which the idler gears that are engaged with the gear racks for said arms are also engaged with each other, and one of the idler gears that is engaged with the gear rack for one of said arms is also engaged with the gear rack for said leg.

11. A toy action figure in accordance with claim 10 including spring means for biasing said leg in one direction to return said leg to its initial position when said leg is not actuated.

12. A toy action figure comprising a hollow torso, a pair of arms, means mounting said arms for movement in a wing-like manner relative to said torso, a pair of legs, means mounting said legs to said torso, one of said legs being mounted for rocking movement toward the other of said legs, and an actuating mechanism for converting the rocking movement of said one leg to a movement that actuates said arms in said wing-like manner, said actuating mechanism including a transmission link movable about one end thereof through an angle within said hollow torso when one leg is manipulated to effect said rocking movement, and gear means within said hollow torso for transmitting movement of said transmission link to said arms.

13. A toy action figure in accordance with claim 12 in which said actuating mechanism includes a transmission link, first gear means associated with said transmission link, second gear means associated with said right arm, third gear means associated with said left arm, and fourth gear means for transmitting the movement of said first gear means to said second and third gear means.

14. A toy action figure in accordance with claim 13 in which said first gear means includes an arcuate gear rack, said second gear means includes an arcuate gear rack, said third gear means includes an arcuate gear rack, and said fourth gear means includes first, second and third idler gears, said first idler gear being in mesh with the arcuate gear rack of said first gear means, said second idler gear being in mesh with the arcuate gear rack of said second gear means, said third idler gear being in mesh with the arcuate gear rack of said third gear means, and said first idler gear being in mesh with said second idler gear and said second idler gear being in mesh with said third idler gear.

15. A toy action figure comprising a hollow torso having a left arm socket and a right arm socket, a left arm having a ball portion integral therewith and received in said left arm socket, a right arm having a ball portion received in said right arm socket, each of said sockets having a slot therein and each of said ball portions having a shank extending inwardly through a respective one of said slots, an arcuate gear rack fixed on the inner end of each said shanks, two pinion gears mounted in said hollow torso, a respective one of said pinion gears being engaged with each of said arcuate gear racks, said pinion gears being engaged with each other, an additional gear mounted in said hollow torso engaged with one of said first-mentioned pinion gears, an arcuate rack engaged with said additional pinion gear, a transmission link, said additional arcuate gear rack being integral with said link, a pair of legs, means connecting one of said legs to the end of said link remote from its arcuate gear rack, so that when said one leg is moved angularly it causes said link to move its said arcuate gear rack and to cause rotation of said pinion gears with the consequence that the arcuate gear racks for said arms cause said arms to rotate about horizontal axes provided by said ball portions and said sockets.

* * * * *